United States Patent [19]

Hauser et al.

[11] Patent Number: 4,925,407

[45] Date of Patent: May 15, 1990

[54] NICKEL-BASED ELECTRICAL CONTACT

[75] Inventors: Joachim J. Hauser, Summit; John T. Plewes, Chatham; Murray Robbins, Berkeley Heights, all of N.J.

[73] Assignee: American Telephone and Telegraph Company, New York, N.Y.

[21] Appl. No.: 823,987

[22] Filed: Jan. 30, 1986

Related U.S. Application Data

[63] Continuation-in-part of Ser. No. 761,402, Aug. 1, 1985, abandoned, which is a continuation-in-part of Ser. No. 646,707, Aug. 31, 1984.

[51] Int. Cl.[5] ..... H01R 9/24

[52] U.S. Cl. ..... 439/887; 439/886

[58] Field of Search ..... 339/278 R, 278 T, 278 C; 439/887, 886

[56] References Cited

U.S. PATENT DOCUMENTS

| | | | |
|---|---|---|---|
| 1,769,229 | 7/1939 | Mandell | 420/435 |
| 2,441,945 | 5/1948 | Frolich et al. | 339/278 C |
| 4,409,295 | 10/1983 | Smith, III et al. | 339/278 C |
| 4,442,182 | 4/1984 | Chart | 339/278 C |
| 4,465,742 | 8/1984 | Nagashima et al. | 339/278 C |
| 4,554,045 | 11/1985 | Bean et al. | 156/613 |

*Primary Examiner*—P. Bradley

*Attorney, Agent, or Firm*—Peter A. Businger

[57] ABSTRACT

Contacts comprising nickel and a glass-forming additive have electrical contact properties which render them suitable as replacements for gold contacts; disclosed contacts have low contact resistance even after prolonged exposure to an oxidizing ambient. The glass-forming additive is one or several of the elements boron, silicon, germanium, phosphorus, arsenic, antimony, or bismuth, and contacts are readily formed, e.g., as layers on substrates. A crystallographically disordered structure is produced in a contact surface layer at least upon exposure to an oxidizing ambient; alternatively, such desired structure can be produced by ion bombardment and even in the absence of glass-forming additives.

14 Claims, 1 Drawing Sheet

NICKEL-BASED ELECTRICAL CONTACT

CROSS-REFERENCE TO RELATED APPLICATION

This application is a continuation-in-part of application Ser. No. 761,402, filed Aug. 1, 1985 now abandoned, which is a continuation-in-part application of my copending application Ser. No. 646,707, filed Aug. 31, 1984.

TECHNICAL FIELD

The invention is concerned with electrical contact surfaces and, more specifically, with nickel-based contact surface materials.

BACKGROUND OF THE INVENTION

Typically, the manufacture of high-quality electrical contacts has involved the use of gold whose properties of low contact resistance and high chemical stability are key advantages in such usage. However, as the price of gold remains high, efforts continue at finding alternative materials for contact manufacture.

Prominent among such alternatives are precious metals other than gold; e.g., silver-palladium alloys have been found suitable for certain applications. While such alternate alloys are less expensive than gold, still further cost reduction is desired, and nonprecious metal alloys such as, e.g., copper-nickel alloys have also been investigated for contact resistance and stability over time. See S. M. Garte et al., "Contact Properties of Nickel-Containing Alloys", *Electrical Contacts,* 1972, Illinois Institute of Technology.

SUMMARY OF THE INVENTION

It has been discovered that certain nickel alloys have contact properties of high stability and low contact resistance comparable to those of gold. Devices in accordance with the invention comprise a contact surface which is the surface of such alloy comprising nickel and at least one glass-forming additional element such as boron, silicon, germanium, phosphorus, arsenic, antimony, or bismuth. The presence of such glass-forming element is considered to inhibit the formation of semiconducting nickel oxide and/or to result in the formation of a thermodynamically more stable compound, preserving metallic conductivity of a contact layer in an oxidizing ambient.

The addition of one or several glass-forming elements results in a crystallographically disordered structure at least upon exposure of the layer to an oxidizing ambient, this as contrasted with the formation of crystalline nickel oxide in the absence of preferred addition of a glass-forming element. Alternatively, crystallographically disordered structure can be produced by ion bombardment, alpha particles being conveniently used for this purpose.

Surface contact resistance less than 100 milliohms is typically maintained even after prolonged exposure to an oxidizing ambient.

DETAILED DESCRIPTION

Figure 1:
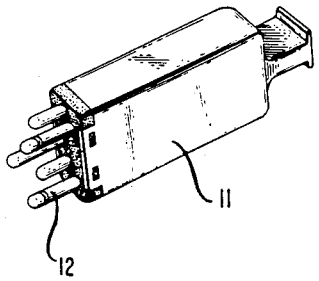
FIG. 1 is a perspective view of an electrical connector device in accordance with the invention.

The electrical connector device shown in FIG. 1 comprises housing 11 and contact pins 12. Housing 11 is made of an electrically insulating material, and contact pins 12 have contact surfaces in accordance with the invention.

Figure 2:
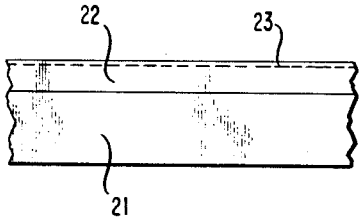
FIG. 2 is a schematic cross-sectional view of a portion of a device in accordance with the invention.

Shown in FIG. 2 are, in cross section, an electrically conducting member 21 on which a surface layer 22 is situated. In accordance with the invention surface layer 22 is made of an alloy of nickel and at least one glass-forming additional element. Upon exposure to an oxidizing atmosphere, portion 23 of layer 22 further comprises oxygen.

Preferred glass-forming additive elements are boron, silicon, germanium, phosphorus, arsenic, antimony, and bismuth, and their presence in the contact layer is in a preferred amount in the range of from 1 to 40 and preferably 2 to 10 atom percent relative to the combined amount of nickel and the additive element; preferred also is the range of from 25 to 35 atom percent where thermodynamically stable, stoichiometric compounds are formed.

In combination, nickel and the glass-forming additive element or elements constitute a preferred amount of at least 70 atom percent of the contact layer material. In the interest of enhanced electrical and mechanical contact properties, the addition of cobalt is desirable, elements other than cobalt preferably being limited to amounts less than 5 atom percent in combination and preferably less than 1 atom percent. Particularly undesirable is the presence of Group VI elements such as sulfur, selenium, and tellurium, and their combined amount is preferably limited to less than 0.5 atom percent.

In the case of non-stoichiometric aggregates, glass-forming additives to nickel are considered to inhibit the formation of semiconducting nickel oxide in an oxidizing ambient. Instead of such semiconducting nickel oxide, in the presence of the glass-forming additive, a surface layer of an aggregation including nickel, oxygen, and the glass-forming additive is believed to be formed in sufficiently large regions of the layer, such aggregation having essentially metallic conduction properties. Based on experimental evidence the thickness of the oxygen-containing surface layer is estimated to be on the order of 25 Angstroms.

Crystallographically disordered structure in nickel-containing layers is produced also upon ion bombardment which results in a crystallographically disordered structure even before exposuree to an oxidizing ambient. Still, it is the disordered, quasi-amorphous, glass-like nature of an oxidized surface portion which is considered to be conducive to desired low contact resistance of a contact layer for use in an oxidizing ambient. A crystallographically disordered nickel aggregate preferably comprises nickel in an amount of at least 50 atom percent.

Contacts of the invention may receive a final coating or "flash" comprising a significant amount of a coating material such as gold, one or several platinum-group elements, or gold and one or several platinum-group elements, the amount being sufficient to impart to the coated surface the appearance of such coating material. The structure of such coating may be essentially homogeneous or layered, and coating thickness typically is in a range of from 0.01 to 0.05 micrometer. For example, a cobalt-hardened gold coating may be electro-deposited from a slightly acidic solution (pH 5) comprising potassium gold cyanide, cobalt citride, and a citric buffer. (The presence of cobalt, nominally in a range of from 0.2 to 0.5 percent by weight, enhances surface hardness especially in the case of thicker coatings.) Preferred temperature of the plating bath is approximately 35 degrees C., and a plating current of approximately 5 milliamperes per $cm^2$ is convenient. Typical plating times are of the order of half a minute. Prior to plating, a surface may be cleaned, e.g., by electrolytic scrubbing in an alkaline solution, rinsing in de-ionized water, and dipping in dilute hydrochloric acid at elevated temperature.

The following examples specifically illustrate the suitability of contacts in accordance with the invention.

EXAMPLE 1

A layer consisting essentially of 95 atomic percent nickel and 5 atomic percent antimony was deposited by getter-sputtering approximately 3 micrometers thick on a copper substrate. Standard four-point probes were used to determine surface contact resistance; such resistance was found to be in the range of from 5 to 7 milliohms. The deposited film was then subjected to a test for stability at elevated temperature and humidity (65 hours at a temperature of 75 degrees C., relative humidity of 95 percent), and contact resistance was then found to be in the range of from 15 to 20 milliohms.

EXAMPLE 2

An experiment was carried out, analogous to Example 1, on a layer consisting essentially of 95 atomic percent nickel and 5 atomic percent phosphorus. Contact resistance was 1.8 milliohm before the test and 4.4 to 5 milliohms after the test.

EXAMPLE 3

An experiment was carried out, analogous to Example 1, on a layer consisting essentially of 95 atomic percent nickel and 5 atomic percent boron. Contact resistance was in the range of from 2.9 to 3.5 milliohms before the test and in the range of from 10 to 14 milliohms after the test.

EXAMPLE 4

An experiment was carried out, analogous to Example 1, on a layer consisting essentially of 95 atomic percent nickel and 5 atomic percent silicon. Contact resistance was in the range of from 1.6 to 2.1 milliohms before the test and in the range of from 4.5 to 6 milliohms after the test.

EXAMPLE 5

An experiment was carried out, analogous to Example 1, on a layer consisting essentially of 95 atomic percent nickel and 5 atomic percent germanium. Contact resistance was in the range of from 1.5 to 1.85 milliohms before the test and 10 to 14 milliohms after the test.

EXAMPLE 6

An aqueous solution was prepared containing 208 gm/l $NiCl_2.6H_2O$, 49 gm/l $H_3PO_4$ 85 percent, and 5 gm/l $H_3PO_3$. The solution was used to electroplate nickel-phosphorus onto a copper electrode; plating bath temperature was 75 degrees C., current density was 150 $mA/cm^2$, and plating rate was approximately 3 micrometers per minute. The deposited layer had a thickness of approximately 4.5 micrometers. Contact resistance of the deposited layer was less than 10 milliohms after exposure to the testing ambient.

EXAMPLE 7

An aqueous solution of 0.087 molar of $As_2O_5$ and 0.5 molar of $NiCl_2.6H_2O$ was prepared. A copper electrode was plated with nickel-arsenic by pulse-plating from the solution at a temperature of 75 degrees C.; current pulses of 200 $mA/cm^2$ were on for 1.5 seconds and off for 0.5 seconds. Deposited layer thickness was approximately 4.5 micrometers. Contact resistance of the deposited layer was less than 10 milliohms after exposure to the testing ambient.

EXAMPLE 8

To a solution of 5 gm $GeO_2$ in 50 cc water plus 4 cc ammonium hydroxide and 0.5 molar of $NiCl_2.6H_2O$, 150 gm/l ammonium citrate were added. The solution was filtered, and ammonium hydroxide was added until pH was 8.5. A layer of nickel-germanium was plated from the solution at a temperature of 75 degrees C. onto a copper electrode; current density was 150 $mA/cm^2$ and plating rate was approximately 2.5 micrometers per minute. Deposited layer thickness was approximately 4.5 micrometers. Contact resistance of the deposited layer was less than 10 milliohms after exposure to the testing ambient.

EXAMPLE 9

A layer of nickel having a thickness of approximately 3500 Angstroms was deposited on a polished copper foil. A portion of the nickel layer was covered with an aluminum foil, and alpha-particles were implanted in the uncovered portion of the nickel layer. Alpha-particles had an energy of approximately 1.8 MeV, and a dose of approximately $1.6\times10^{16}$ particles per $cm^2$ was found to be optimal or near-optimal for minimized contact resistance (less than 10 milliohms) after exposure to humid air at elevated temperature as described in Example 1 above. (This test is considered to be an approximate equivalent of exposure to ordinary atmospheric conditions for a duration of 5 years.) Also, visual inspection of the implanted portion after the test as compared with the portion which had been covered with aluminum foil, showed the latter to be dull and brownish while the former appeared bright and shiny.

What is claimed is:

1. Apparatus comprising an electrical contact, said contact comprising a surface of a body of contact material, said contact material comprising nickel and at least one glass-forming additive selected from the group consisting of boron, germanium, phosphorus, arsenic, antimony, and bismuth, said at least one glass-forming additive being present in said contact material in an amount in the range from 2 to 10 atom percent of the combined amount of nickel and said at least one additional element, said combined amount being greater than or equal to 70 atom percent of said contact material, whereby at least a surface portion of said contact material is crystallographically disordered at least upon exposure to an oxidizing ambient.

2. Apparatus of claim 1, the presence of sulfur, selenium, and tellurium in combination being limited in said contact material to less than 0.5 atomic percent.

3. Apparatus of claim 1, said contact material further comprising cobalt.

4. Apparatus of claim 1 in which said at least one glass-forming additive is boron.

5. Apparatus of claim 1 in which said at least one glass-forming additive is germanium.

6. Apparatus of claim 1 in which said at least one glass-forming additive is phosphorus.

7. Apparatus of claim 1 in which said at least one glass-forming additive is arsenic.

8. Apparatus of claim 1 in which said at least one glass-forming additive is antimony.

9. Apparatus of claim 1 in which said at least one glass-forming additive is bismuth.

10. Apparatus of claim 1, said surface having a contact resistance which is less than 100 milliohms.

11. Apparatus of claim 1, said body of contact material being in the form of a layer deposited on a substrate.

12. Apparatus of claim 1, said contact material having a surface coating which consists essentially of a coating material selected from the group consisting of gold, one or several platinum-group elements, and gold and one or several platinum-group elements.

13. Apparatus of claim 12, the amount of said coating material being sufficient to produce a surface appearance of said coating material.

14. Apparatus of claim 12, said surface coating having a thickness in the range from 0.01 to 0.05 micrometer.

* * * * *